US009822753B2

(12) United States Patent
Ishitani et al.

(10) Patent No.: US 9,822,753 B2
(45) Date of Patent: Nov. 21, 2017

(54) IGNITION CONTROL DEVICE

(71) Applicant: DENSO CORPORATION, Kariya, Aichi-pref. (JP)

(72) Inventors: Masahiro Ishitani, Kariya (JP); Akimitsu Sugiura, Kariya (JP); Makoto Toriyama, Kariya (JP); Satoru Nakayama, Kariya (JP); Yuuki Kondou, Kariya (JP)

(73) Assignee: DENSO CORPORATION, Kariya (JP)

( * ) Notice: Subject to any disclaimer, the term of this patent is extended or adjusted under 35 U.S.C. 154(b) by 158 days.

(21) Appl. No.: 14/903,897

(22) PCT Filed: Jul. 4, 2014

(86) PCT No.: PCT/JP2014/067958

§ 371 (c)(1),
(2) Date: Jan. 8, 2016

(87) PCT Pub. No.: WO2015/005245

PCT Pub. Date: Jan. 15, 2015

(65) Prior Publication Data

US 2016/0146176 A1 May 26, 2016

(30) Foreign Application Priority Data

Jul. 11, 2013 (JP) ..... 2013 145621

(51) Int. Cl.
*F02P 9/00* (2006.01)
*F02P 3/08* (2006.01)
(Continued)

(52) U.S. Cl.
CPC ..... *F02P 9/002* (2013.01); *F02P 3/0838* (2013.01); *F02P 3/0846* (2013.01); *F02P 3/093* (2013.01); *F02P 9/007* (2013.01); *F02P 15/10* (2013.01)

(58) Field of Classification Search
CPC .... F02P 9/00; F02P 9/002; F02P 9/007; F02P 3/0838; F02P 3/0846; F02P 3/093; F02P 15/10
See application file for complete search history.

(56) References Cited

U.S. PATENT DOCUMENTS 4,413,608 A 11/1983 Beeghly
4,892,080 A * 1/1990 Morino ..... F02P 3/005 123/604
2007/0175461 A1 8/2007 Wada et al.

FOREIGN PATENT DOCUMENTS

JP 2-20466 6/1990
JP 2000-199470 7/2000
(Continued)

OTHER PUBLICATIONS

International Preliminary Report on Patentability dated Jan. 12, 2016 issued in corresponding International Application No. PCT/JP2014/067958 (7 pgs.) with an at least partial English language translation (8 pgs.).

(Continued)

*Primary Examiner* — Hieu T Vo
(74) *Attorney, Agent, or Firm* — Nixon & Vanderhye PC

(57) ABSTRACT

An ignition control device includes a control unit to control first to third switching elements so that during ignition discharge, which is started by turning off the first switching element, energy stored on a capacitor is discharged by turning off the third switching element and turning on the second switching element for supplying a primary current to an end of a primary winding opposite to an end thereof connected to a direct-current power supply. During inductive discharge of a spark plug, the control unit non-intermittently turns on the second switching element so that the second switching element is turned on over a successive (Continued)

energy input time period, according to the operating conditions of an internal combustion engine.

3 Claims, 3 Drawing Sheets

(51) Int. Cl.
*F02P 3/09* (2006.01)
*F02P 15/10* (2006.01)

(56) References Cited

FOREIGN PATENT DOCUMENTS

| | | |
|---|---|---|
| JP | 2002-303238 | 10/2002 |
| JP | 2007-224795 | 9/2007 |
| JP | 2007-231927 | 9/2007 |
| JP | 2014-206061 | 10/2014 |

OTHER PUBLICATIONS

International Search Report (1 pg.) dated Aug. 19, 2014 issued in corresponding International Application No. PCT/JP2014/067958 (2 pgs.).

* cited by examiner

IGNITION CONTROL DEVICE

This application is the U.S. national phase of International Application No. PCT/JP2014/067958 file 4 Jul. 2014 which designated the U.S. and claims priority to JP Patent Application No. 2013-145621 filed 11 Jul. 2013, the entire contents of each of which are hereby incorporated by reference.

BACKGROUND

Technical Field

The present invention relates to an ignition control device configured to control the operation of a spark plug provided to ignite an air fuel mixture inside the cylinder of an internal combustion engine, and more particularly to an ignition device provided with an auxiliary power supply which is aimed to sustain discharge by passing current in a superposed manner by performing switching after start of discharge.

Background Art

In this type of devices, there is known a device configured to perform a so-called multiple discharge to create a good combustion state for an air fuel mixture. For example, PTL 1 discloses a technique in which discharge is intermittently caused a plurality of times in one combustion cycle. On the other hand, PTL 2 discloses a technique in which two ignition coils are connected parallel to each other to attain multiple discharge characteristics exhibiting a long duration of discharge.

Patent Literature (PTL) 1 JP-A-2007-231927
Patent Literature (PTL) 2 JP-A-2000-199470

Technical Problem

As in the configuration described in PTL 1, in the case where a discharge is intermittently performed several times in one combustion cycle, ignition discharge current is repeatedly returned to zero from the start to the end of ignition discharge in the combustion cycle. In this case, particularly when a gas flow rate in the cylinder is large, a so-called blow-off occurs, which can cause a problem of ignition energy loss. On the other hand, as described in PTL 2, in a configuration in which two ignition coils are connected parallel to each other, ignition discharge current is not repeatedly returned to zero from the start to the end of ignition discharge in one combustion cycle. However, this configuration has a problem of complicating the device configuration and increasing the device size. Such conventional art also suffers from a problem of having to provide a configuration which produces much greater energy than necessary for ignition, thus causing needless power consumption.

SUMMARY

In light of the circumstances set forth above, it is desired to provide an ignition control device that can minimize the occurrence of the blow-off and the ignition energy loss accompanying the blow-off.

An ignition control device according to the present invention is configured to control the operation of a spark plug. The spark plug is provided to ignite an air fuel mixture inside the cylinder of an internal combustion engine. The ignition control device according to the present invention includes an ignition coil, a direct-current power supply, a first switching element, a second switching element, a third switching element, an energy storage coil, a capacitor, and a control unit.

The ignition coil includes a primary winding and a secondary winding. The ignition coil is configured to generate a secondary current in the secondary winding by increasing/decreasing a primary current passed through the primary winding. To one end of the primary winding, a non-grounded side output terminal of the direct-current power supply is connected to pass the primary current through the primary winding. The secondary winding is connected to the spark plug.

The first switching element has a first control terminal, a first power supply side terminal, and a first grounded side terminal. The first switching element is a semiconductor switching element and is configured to control the turning on/off of the current across the first power supply side terminal and the first grounded side terminal on the basis of a first control signal inputted to the first control terminal. In the first switching element, the first power supply side terminal is connected to the other end of the primary winding. The first grounded side terminal is connected to the ground.

The second switching element has a second control terminal, a second power supply side terminal, and a second grounded side terminal. The second switching element is a semiconductor switching element and is configured to control the turning on/off of the current across the second power supply side terminal and the second grounded side terminal on the basis of a second control signal inputted to the second control terminal. In the second switching element, the second grounded side terminal is connected to the other end of the primary winding.

The third switching element has a third control terminal, a third power supply side terminal, and a third grounded side terminal. The third switching element is a semiconductor switching element and is configured to control the turning on/off of the current across the third power supply side terminal and the third grounded side terminal on the basis of a third control signal inputted to the third control terminal. In the third switching element, the third power supply side terminal is connected to the second power supply side terminal of the second switching element. The third grounded side terminal is connected to the ground.

The energy storage coil is an inductor provided to store energy by turning on the third switching element. The energy storage coil is interposed in an electric power line connecting the non-grounded side output terminal of the direct-current power supply to the third power supply side terminal of the third switching element.

The capacitor is connected in series with the energy storage coil, being located at a position between the non-grounded side output terminal of the direct-current power supply and the ground. The capacitor is provided such that energy is stored by turning off the third switching element.

The control unit is provided to control the second switching element and the third switching element. Specifically, the control unit is ensured to control the switching elements so that, during ignition discharge at the spark plug, which is started by turning off the first switching element, the capacitor discharges the stored energy by turning on the second switching element to thereby supply the primary current from the other end to the primary winding.

In particular, in the present invention, during ignition discharge (typically during inductive discharge), the control unit is ensured to non-intermittently turn on the second switching element over a successive energy input time period (over a predetermined time period according to the operating conditions of the internal combustion engine).

First, a typical operation of the ignition control device according to the present invention having such a configuration will be described. The primary current is passed through the primary winding by turning on the first switching element and turning off the second switching element. Thus, the ignition coil is charged. In the meantime, the third switching element is turned on, so that energy is stored in the energy storage coil. When the third switching element is turned off with the second switching element being turned off, the stored energy is discharged from the energy storage coil and stored in the capacitor.

When the first switching element is turned off, the primary current that has been passed through the primary winding is suddenly interrupted. Then, a high voltage is generated in the primary winding of the ignition coil, and the high voltage is further stepped up in the secondary winding. As a result, a high voltage is generated at the spark plug to thereby cause discharge. At this time, the secondary current that is a high current is generated in the secondary winding. In this way, the ignition discharge is started at the spark plug.

As commonly known, a so-called capacitive discharge state is created immediately after start of ignition discharge, following which, a so-called inductive discharge state is created. During the inductive discharge, the secondary current (hereinafter may also be referred to as discharge current), if left as it is (i.e. according to the conventional art), decreases with time and returns to zero.

In this regard, in the configuration of the present invention, the second switching element is turned on during the ignition discharge (inductive discharge), so that the stored energy is discharged from the capacitor. The energy discharged from the capacitor is supplied from the other end to the primary winding to pass the primary current through the primary winding. With the input of the energy, energy is superposed on the decreasing ignition discharge current, well ensuring the ignition discharge (inductive discharge) to an extent of being sustained.

The state of flow of the discharge current during the ignition discharge (inductive discharge) can be appropriately controlled by adjusting the amount of discharge of stored energy from the capacitor with the turning on/off of the second switching element. Therefore, in the ignition control device of the present invention, the control unit non-intermittently turns on the second switching element over the successive energy input time period, during the ignition discharge (inductive discharge). Specifically, for example, the second switching element is successively turned on over the successive energy input time period, and the energy stored in the capacitor is intensively inputted in a first half of the input time period so that the ignition discharge can be sustained in a high velocity field as well. As a result, the primary current, in which the waveform of the secondary current is changed in an arc shape, is supplied from the other end to the primary winding.

As described above, according to the ignition control device of the present invention, the energy (primary current) for sustaining the ignition discharge (inductive discharge) is easily and favorably supplied to the primary winding. In other words, the discharge current can be increased. Thus, the discharge current is well controlled in conformity with the state of gas flow in the cylinder to thereby maintain the discharge current to a level, or higher than the level, of not causing the blow-off that may lead to a fire.

Thus, according to the present invention, the occurrence of the blow-off and its associated ignition energy loss are well minimized with a simple device configuration owing to the non-intermittent (continuous) input of energy. In other words, according to the present invention, the combustion state of the air fuel mixture can be favorably stabilized, while minimizing the increase in the size and manufacturing cost of the ignition control device as much as possible.

In particular, as described above, in the present invention, energy is inputted from the other end of the primary winding, i.e., from the low voltage side (the grounded side or the first switching element side). Thus, energy can be inputted at a lower voltage than in the case where energy is inputted from the secondary winding at a high voltage.

In this regard, if energy is inputted at a voltage higher than that of the direct-current power supply from the power supply side of the primary winding (from the direct-current power supply side, i.e., from the one end) while the first switching element is in an on state, efficiency is impaired due to the current inputted to the direct-current power supply, for example. On the contrary, according to the present invention, as described above, energy is inputted from the low voltage side of the primary winding while the first switching element is in an off state. This way of energy input exerts a good effect of superposing energy during discharge, and of most easily and efficiently inputting energy to the primary winding.

DESCRIPTION OF THE EMBODIMENTS

With reference to the drawings, hereinafter is described an embodiment of the present invention.

<Configuration of Engine System>

Figure 1:
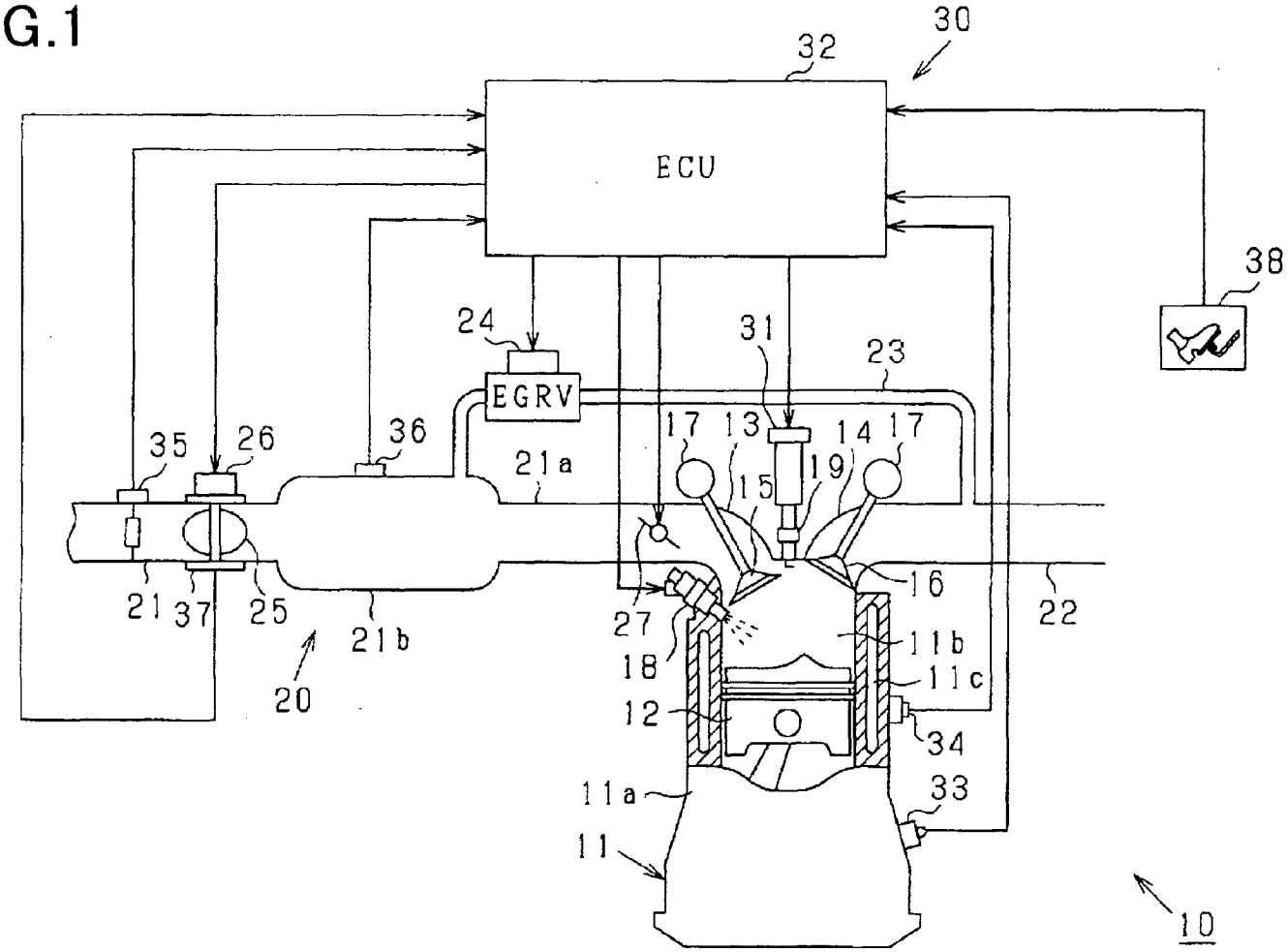
FIG. 1 is a schematic configuration diagram illustrating an engine system to which an ignition control device according to an embodiment of the present invention is applied.

Referring to FIG. 1, an engine system 10 includes an engine 11 that is a spark ignition type internal combustion engine. The engine 11 has a main body configured by an engine block 11*a*. The engine block 11*a* has an interior in which a cylinder 11*b* and a water jacket 11*c* are formed. The cylinder 11*b* is provided to accommodate a piston 12 therein such that the piston is reciprocally movable. The water jacket 11*c* is a space through which a coolant (also referred to as cooling water) can flow. The water jacket 11*c* is provided so as to enclose the cylinder 11*b*.

The engine block 11*a* has an upper part that is a cylinder head on which an intake port 13 and an exhaust port 14 are formed so as to be able to communicate with the cylinder 11*b*. The cylinder head is mounted with an intake valve 15, an exhaust valve 16, and a valve driving mechanism 17. The intake valve 15 is provided such that the communication state between the intake port 13 and the cylinder 11*b* can be changed. The exhaust valve 16 is provided such that the communication state between the exhaust port 14 and the cylinder 11*b* can be changed. The valve driving mechanism 17 is configured to open/close the intake valve 15 and the exhaust valve 16 at predetermined time points.

The engine block 11*a* is mounted with an injector 18 and a spark plug 19. In the present embodiment, the injector 18 is provided such that the fuel is directly injected into the cylinder 11*b*. The spark plug 19 is provided such that an air fuel mixture is ignited in the cylinder 11*b*.

To the engine 11, an air supply/exhaust mechanism 20 is connected. The air supply/exhaust mechanism 20 is provided with three types of gas passages which are an intake pipe 21 (including an intake manifold 21*a* and a surge tank 21*b*), an exhaust pipe 22, and an EGR passage 23 (EGR stands for Exhaust Gas Recirculation).

The intake manifold 21*a* is connected to the intake port 13. The surge tank 21*b* is disposed upstream of the intake manifold 21*a* in an intake air flow direction. The exhaust pipe 22 is connected to the exhaust port 14.

The EGR passage 23 connects the exhaust pipe 22 to the surge tank 21*b* so as to be able to introduce a part of an exhaust gas discharged to the exhaust pipe 22 into intake air. The EGR passage 23 is interposed by an EGR control valve 24. The EGR control valve 24 is provided such that an EGR rate (mixing rate of an exhaust gas in a gas taken into the cylinder 11*b* before being combusted) can be controlled according to the opening of the EGR control valve 24.

The intake pipe 21 is interposed by a throttle valve 25 which is located upstream of the surge tank 21*b* in the intake air flow direction. The opening of the throttle valve 25 is ensured to be controlled by the operation of a throttle actuator 26, such as a DC motor. Near the intake port 13, an air flow control valve 27 is provided to generate a swirl flow or a tumble flow.

The engine system 10 is provided with an ignition control device 30. The ignition control device 30 is configured to control the operation of the spark plug 19 (i.e., to control ignition of the engine 11). The ignition control device 30 includes an ignition circuit unit 31 and an electronic control unit 32.

The ignition circuit unit 31 is configured to generate spark discharge at the spark plug 19 for igniting the air fuel mixture in the cylinder 11*b*. The electronic control unit 32 is a so-called engine ECU (ECU stands for Electronic Control Unit). The electronic control unit 32 controls the operations of the components including the injector 18 and the ignition circuit unit 31 according to the operating conditions of the engine 11 acquired based on the outputs of various sensors, such as a rotation speed sensor 33 (hereinafter is referred to as engine parameters).

As for ignition control, the electronic control unit 32 generates and outputs an ignition signal IGt and an energy input period signal IGw on the basis of the acquired engine parameters. The ignition signal IGt and the energy input period signal IGw define an optimum ignition timing and a discharge current (ignition discharge current) according to the state of gas in the cylinder 11*b* and the necessary output of the engine 11 (these are changed depending on the engine parameters). These signals are already publicly or commonly known. Thus, in the present description, more detailed description of these signals is omitted. See JP-A-2002-168170 (U.S. Pat. No. 6,557,537) and other patent literature as necessary. However, in these publicly or commonly known technical literatures, the signal IGw is referred to as a multi-period signal or a discharge interval signal, for example.

The rotation speed sensor 33 detects (acquires) an engine speed (also referred to as the number of revolutions of the engine) Ne. The rotation speed sensor 33 is mounted to the engine block 11*a* to generate a pulsed output according to the rotation angle of a crank shaft, not shown, that rotates in association with the reciprocating motion of the piston 12. A cooling water temperature sensor 34 detects (acquires) a cooling water temperature Tw that is the temperature of the coolant circulating through the water jacket 11*c*. The cooling water temperature sensor 34 is mounted to the engine block 11*a*.

An air flow meter 35 is a sensor for detecting (acquiring) an intake air quantity Ga (mass flow rate of intake air circulating through the intake pipe 21 and introduced into the cylinder 11*b*). The air flow meter 35 is mounted to the intake pipe 21, being located upstream of the throttle valve 25 in the intake air flow direction. An intake pressure sensor 36 detects (acquires) an intake pressure Pa that is a pressure in the intake pipe 21. The intake pressure sensor 36 is mounted to the surge tank 21*b*.

A throttle opening sensor 37 is incorporated in the throttle actuator 26 and generates an output according to the opening of the throttle valve 25 (throttle position THA). An accelerator position sensor 38 is provided to generate an output according to a manipulated variable (accelerator manipulated variable ACCP) of an accelerator, not shown.

<Configuration of Ignition Control Device>

Figure 2:
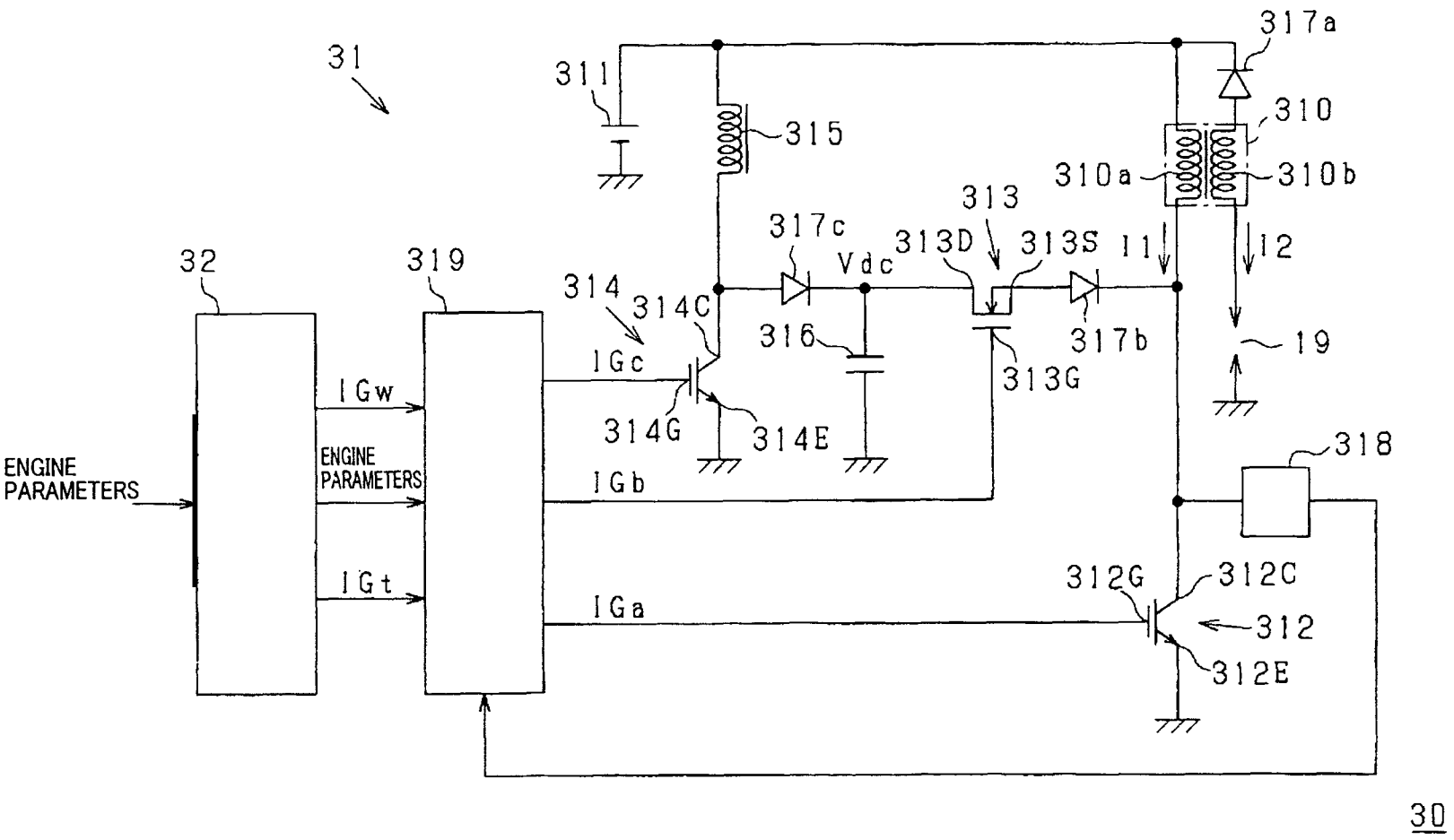
FIG. 2 is a diagram illustrating a schematic circuit configuration of the ignition control device illustrated in FIG. 1.

Referring to FIG. 2, the ignition circuit unit 31 is provided with an ignition coil 310 (including a primary winding 310*a* and a secondary winding 310*b*), a direct-current power supply 311, a first switching element 312, a second switching element 313, a third switching element 314, an energy storage coil 315, a capacitor 316, diodes 317*a*, 317*b*, and 317*c*, a primary voltage acquiring section 318, and a driver circuit 319.

As described above, the ignition coil 310 includes the primary winding 310*a* and the secondary winding 310*b*. As commonly known, the ignition coil 310 is so configured that a primary current passing through the primary winding 310*a* is increased/decreased to thereby generate a secondary current in the secondary winding 310*b*.

The primary winding 310*a* has one end that is a power supply side terminal (can also be referred to as a non-grounded side terminal) to which a non-grounded side output terminal (specifically, plus (+) terminal) of the direct-current power supply 311 is connected. Also, the primary winding 310*a* has the other end that is a low voltage side terminal (can also be referred to as a grounded side terminal) which is connected to the ground via the first switching element 312. In other words, the direct-current power supply 311 is provided such that the primary current is passed through the primary winding 310*a* from the power supply side terminal toward the low voltage side terminal when the first switching element 312 is turned on.

The secondary winding 310*b* has a power supply side terminal (can also be referred to as a non-grounded side terminal) which is connected to the power supply side terminal of the primary winding 310*a* via the diode 317*a*. The diode 317*a* has an anode connected to a high voltage side terminal of the secondary winding 310*b*. In other words, the diode 317*a* is provided such that the secondary current (discharge current) will be regulated to flow from the spark plug 19 toward the secondary winding 310*b* (i.e., in a direction that a current I2 in the figure will have a negative value), while inhibiting current from passing from the high voltage side terminal of the primary winding 310*a* toward the high voltage side terminal of the secondary winding 310*b*. On the other hand, the low voltage side terminal of the secondary winding 310*b* (can also be referred to as a grounded side terminal) is connected to the spark plug 19.

The first switching element 312 is an IGBT (IGBT stands for Insulated Gate Bipolar Transistor), which is a MOS gate structure transistor, having a first control terminal 312G, a first power supply side terminal 312C, and a first grounded side terminal 312E. The first switching element 312 is configured to control the turning on/off of the current across the first power supply side terminal 312C and the first grounded side terminal 312E on the basis of a first control signal IGa inputted to the first control terminal 312G. In the present embodiment, the first power supply side terminal 312C is connected to the low voltage side terminal of the primary winding 310*a*. The first grounded side terminal 312E is connected to the ground.

The second switching element 313 is a MOSFET (MOSFET stands for Metal Oxide Semiconductor Field Effect Transistor) having a second control terminal 313G, a second power supply side terminal 313D, and a second grounded side terminal 313S. The second switching element 313 is configured to control the turning on/off of the current across the second power supply side terminal 313D and the second grounded side terminal 313S on the basis of a second control signal IGb inputted to the second control terminal 313G.

In the present embodiment, the second grounded side terminal 313S is connected to the low voltage side terminal of the primary winding 310*a* via the diode 317*b*. The diode 317*b* has an anode connected to the second grounded side terminal 313S. In other words, the diode 317*b* is provided such that current is allowed to flow from the second grounded side terminal 313S of the second switching element 313 toward the low voltage side terminal of the primary winding 310*a*.

The third switching element 314 is an IGBT, which is a MOS gate structure transistor, having a third control terminal 314G, a third power supply side terminal 314C, and a third grounded side terminal 314E. The third switching element 314 is configured to control the turning on/off of the current across the third power supply side terminal 314C and the third grounded side terminal 314E on the basis of a third control signal IGc inputted to the third control terminal 314G.

In the present embodiment, the third power supply side terminal 314C is connected to the second power supply side terminal 313D of the second switching element 313 via the diode 317*c*. The diode 317*c* has an anode connected to the third power supply side terminal 314C. In other words, the diode 317*c* is provided such that current is allowed to flow from the third power supply side terminal 314C of the third switching element 314 to the second power supply side terminal 313D of the second switching element 313. The third grounded side terminal 314E of the third switching element 314 is connected to the ground.

The energy storage coil 315 is an inductor interposed in an electric power line connecting the non-grounded side output terminal of the direct-current power supply 311 to the third power supply side terminal 314C of the third switching element 314. The energy storage coil 315 is provided such that energy (electromagnetic energy) is stored therein when the third switching element 314 is turned on and the stored energy is discharged when the third switching element 314 is turned off.

The capacitor 316 and the energy storage coil 315 are serially connected to each other, being located between the ground of the capacitor 316 and the non-grounded side output terminal of the direct-current power supply 311. In other words, the capacitor 316 is connected to the energy storage coil 315, while being parallel to the third switching element 314. The capacitor 316 is provided to store energy discharged from the energy storage coil 315 when the third switching element 314 is turned off.

The primary voltage acquiring section 318 is connected to a position between the low voltage side terminal of the primary winding 310*a* and the first power supply side terminal 312C of the first switching element 312. The primary voltage acquiring section 318 is a commonly known voltage detection circuit, and is configured to generate an output according to a primary voltage (voltage applied to the primary winding 310*a*) and to input the output to the driver circuit 319. In other words, the primary voltage acquiring section 318 is provided so that the driver circuit 319 can acquire the primary voltage on the basis of the output, for use in detecting a secondary voltage and for detection of a sign of blow-off of a spark. In blow-off, a spark is prolonged and thus the discharge voltage is increased. The increased voltage then can be detected on the primary coil side.

The driver circuit 319 is connected to the electronic control unit 32 so as to receive the engine parameters, the ignition signal IGt, and the energy input period signal IGw outputted from the electronic control unit 32. The driver circuit 319 is connected to the first control terminal 312G, the second control terminal 313G, and the third control terminal 314G to control the first switching element 312, the second switching element 313, and the third switching element 314, respectively. The driver circuit 319 is provided to output the first control signal IGa, the second control signal IGb, and the third control signal IGc to the first control terminal 312G, the second control terminal 313G, and the third control terminal 314G, respectively, on the basis of the received ignition signal IGt and the energy input period signal IGw.

The driver circuit 319 configuring the control unit of the present invention is ensured to cause the capacitor 316 to discharge the stored energy by turning off the third switching element 314 and turning on the second switching element 313 during ignition discharge (started by turning off the first switching element 312) performed by the spark plug 19. In other words, the driver circuit 319 controls the switching elements as mentioned above, so that the capacitor 316 is ensured to discharge energy (electrostatic energy), and the energy is ensured to be supplied from the low voltage side terminal to the primary winding 310*a* during ignition discharge (inductive discharge), as energy for passing the primary current through the primary winding 310*a* (hereinafter referred to as input energy).

In the present embodiment, the driver circuit 319 is ensured to control the second switching element 313 on the basis of the primary voltage acquired by the primary voltage acquiring section 318. Specifically, the driver circuit 319 is ensured to retain the off state of the second switching element 313 during inductive discharge until the primary voltage exceeds a predetermined value Vref, while being ensured to start turning on the second switching element 313 when the primary voltage exceeds the predetermined value Vref.

In particular, in the present embodiment, the driver circuit 319 is ensured to non-intermittently turn on the second switching element 313 during inductive discharge at the spark plug 19, so that the second switching element 313 is turned on during a successive energy input time period (predetermined time period in accord with the engine parameters, i.e. the operating conditions, of the engine 11). As a result, energy can be intensively inputted. Specifically, the driver circuit 319 is ensured to successively turn on the second switching element 313 from a time point when the primary voltage has exceeded the predetermined value Vref until the successive energy input time period is elapsed, so that the waveform of the primary current supplied from the low voltage side terminal to the primary winding 310*a* is changed into an arc shape.

<Description of Operation>

The following description sets forth an operation (operation and effect) based on the configuration of the present embodiment. In a time chart of FIG. 3, the voltage of the capacitor 316 is indicated by Vdc, the primary voltage is indicated by V1, the primary current is indicated by I1, the secondary current is indicated by I2, and the input energy (energy discharged from the capacitor 316 and supplied to the primary winding 310*a* via its low voltage side terminal) is indicated by P.

Figure 3:
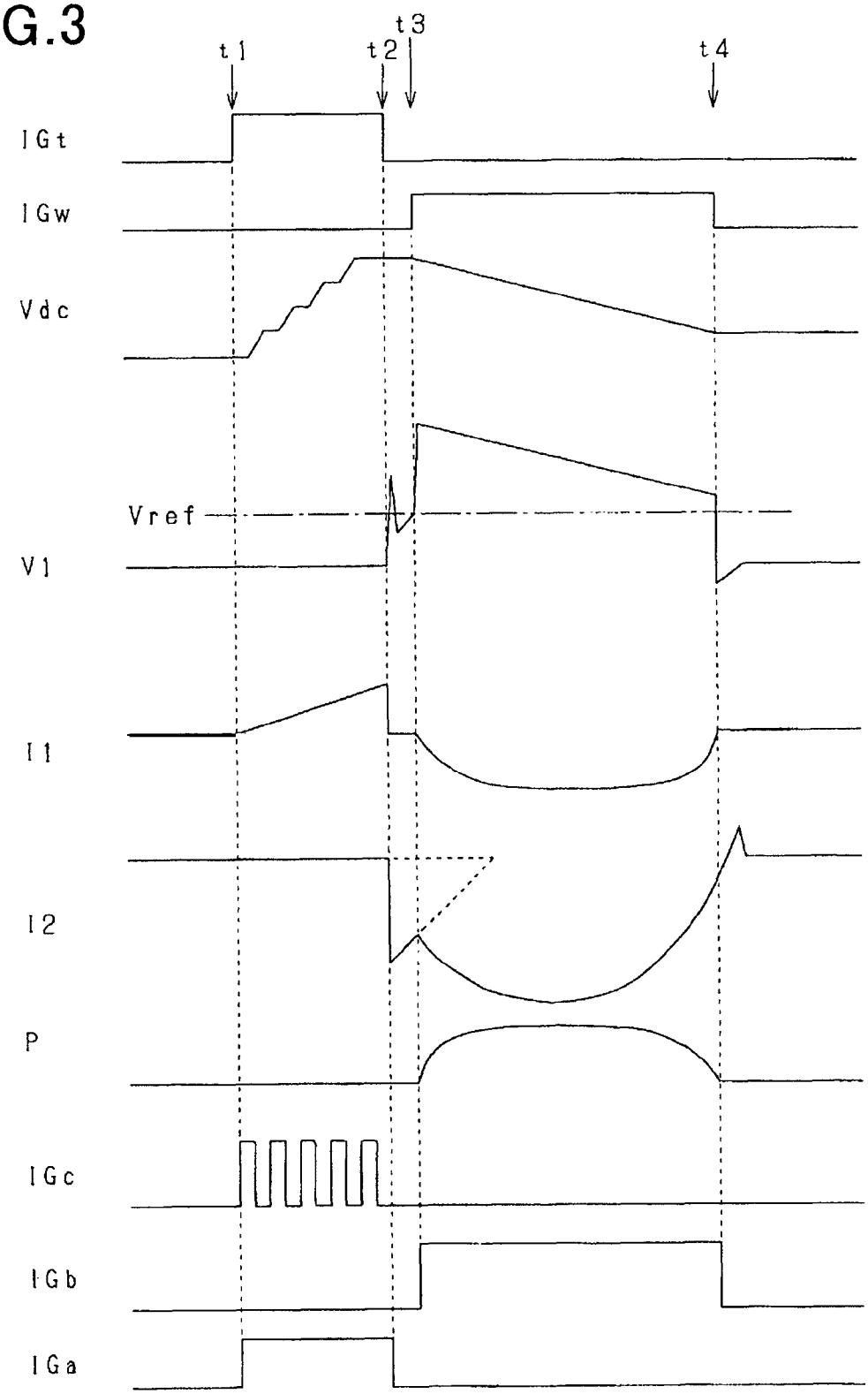
FIG. 3 is a time chart illustrating an example of an operation of the ignition control device illustrated in FIG. 2.

In FIG. 3, the time chart associated with the primary current I1 and the secondary current I2 is shown so that the directions indicated by the arrows in FIG. 2 correspond to a positive direction. In the time chart associated with the ignition signal IGt, the energy input period signal IGw, the first control signal IGa, the second control signal IGb and the third control signal IGc, a state where the signal has risen upward in the figure corresponds to H, and a state where the signal has fallen downward in the figure corresponds to L.

The electronic control unit 32 controls the operations of the components of the engine system 10, including the injector 18 and the ignition circuit unit 31, according to the engine parameters acquired on the basis of the outputs of various sensors, such as the rotation speed sensor 33. The following sets forth details of the ignition control. The electronic control unit 32 generates the ignition signal IGt and the energy input period signal IGw on the basis of the acquired engine parameters. Then, the electronic control unit 32 outputs the generated ignition signal IGt and energy input period signal IGw, as well as the engine parameters, to the driver circuit 319.

Upon receiving the ignition signal IGt, the energy input period signal IGw and the engine parameters outputted from the electronic control unit 32, the driver circuit 319 outputs the first control signal IGa for controlling the turning on/off of the first switching element 312, the second control signal IGb for controlling the turning on/off of the second switching element 313, and the third control signal IGc for controlling the turning on/off of the third switching element 314 on the basis of the received signals and parameters.

In the present embodiment, the first control signal IGa is the same as the ignition signal IGt. Thus, the driver circuit 319 outputs the received ignition signal IGt, as it is, to the first control terminal 312G of the first switching element 312.

On the other hand, in the present embodiment, the second control signal IGb is permitted to rise at a time point when the energy input period signal IGw has risen and the primary voltage has exceeded the predetermined value Vref to thereby successively keep an on state while these conditions are met. Accordingly, the driver circuit 319 generates the second control signal IGb on the basis of the received engine parameters and the energy input period signal IGw, as well as the primary voltage acquired by the primary voltage acquiring section 318, and outputs the second control signal IGb to the second control terminal 313G of the second switching element 313.

The driver circuit 319 generates the third control signal IGc on the basis of the received ignition signal IGt and the engine parameters, and outputs the third control signal IGc to the third control terminal 314G of the third switching element 314. In the present embodiment, the third control signal IGc is a rectangular wave pulsed signal of a constant cycle, which is repeatedly outputted while the ignition signal IGt is at the H level. The third control signal IGc has a duty ratio that is constant between time t1 and time t2, and determined on the basis of the engine parameters.

Referring to FIGS. 1 and 2 and the time chart of FIG. 3, the operation of the configuration of the present embodiment will be chronologically described in further detail. First, the electronic control unit 32 acquires the engine parameters, such as the accelerator manipulated variable ACCP, at a predetermined crank angle of some cylinder 11*b*. Then, before time t1 of FIG. 3, the electronic control unit 32 determines ignition timing of the cylinder 11*b* of the present combustion cycle on the basis of the acquired engine parameters. Thus, the ignition signal IGt and the energy input period signal IGw of the present combustion cycle are generated.

In the present specific example, the time from the rise of the ignition signal IGt until the rise of the energy input period signal IGw, i.e. the time interval between time t2 and time t3, is set based on the engine parameters. Specifically, the electronic control unit 32 appropriately sets the time interval between time t2 and time t3 on the basis of the engine speed Ne and the intake air quantity Ga (using a map, for example) so that the occurrence of blow-off is minimized as much as possible.

When the ignition signal IGt rises to the H level at time t1, the first control signal IGa rises to the H level accordingly. Thus, the first switching element 312 is turned on (since the energy input period signal IGw in this case is at the L level, the second switching element 313 is in an off state). Then, the primary current is started to pass through the primary winding 310*a*, thereby charging the ignition coil 310.

While the ignition signal IGt is at the H level, the rectangular wave pulsed third control signal IGc is inputted to the third control terminal 314G of the third switching element 314. When the third switching element 314 is turned on, energy is stored in the energy storage coil 315. When the third switching element 314 is turned off under the condition that the second switching element 313 is in an off state, the stored energy is discharged from the energy storage coil 315 and stored in the capacitor 316. In this way, by turning on/off the third switching element 314, energy is stored in the capacitor 316 via the energy storage coil 315, and the voltage Vdc is increased stepwise. Storage of energy in the capacitor 316 is completed by time t2.

After that, at time t2, in a state where the second switching element 313 and the third switching element 314 are in an off state (in a state where the off state is maintained), the first control signal IGa falls from the H level to the L level to turn off the first switching element 312. Then, the primary current that has been passed through the primary winding 310*a* is suddenly interrupted. With the interruption, a high voltage is generated in the spark plug 19 to cause discharge. At this time, a large secondary current (discharge current) is generated at the secondary winding 310*b*. In this way, ignition discharge is started in the spark plug 19.

As commonly known, the state immediately after start of ignition discharge at time t2 corresponds to a so-called capacitive discharge state which, then, turns to a so-called inductive discharge state. In the discharge control based on conventional art (or under the operating conditions where the energy input period signal IGw is retained at the L level without being permitted to rise to the H level), the secondary current nears zero with time during the inductive discharge and is attenuated to an extent of disabling sustainment of discharge (see the broken line of figure). The magnitude of discharge energy (energy applied to the spark plug 19) in this case corresponds to the area inside the triangle shown by the broken line in the time chart of FIG. 3 associated with the secondary current I2.

In particular, as commonly known, under the high load or high rotation operating conditions (the intake pressure Pa is high, the engine speed Ne is high, the throttle position THA provides a large opening, the EGR ratio is high, and the air-fuel ratio is lean), the blow-off is likely to occur, being attributed to the rate of air flow in the cylinder 11*b* or the leaning. In such a situation where the blow-off is likely to occur, a discharge sustaining voltage (secondary voltage necessary for sustaining discharge sparks) rises. In other words, in such a situation, the discharge sustaining voltage increases due to the prolonged discharge sparks, for example, which are attributed to the air flow in the cylinder 11*b*. As a result, the discharge current is attenuated and the blow-off is easily caused.

In response to the situation where the blow-off is likely to occur, the secondary voltage increases. The increase of the secondary voltage induces increase of the primary voltage in accord with the turn ratio of the ignition coil 310. Therefore, in the present embodiment, the primary voltage acquiring section 318 acquires (monitors) the primary voltage. Thus, the tendency of causing the blow-off in the cylinder 11*b* can be monitored.

In the present embodiment, at time t3 immediately after time t2, the energy input period signal IGw is permitted to rise to the H level. During the establishment of the conditions where the energy input period signal IGw rises and the primary voltage exceeds the predetermined value Vref, the second control signal IGb is permitted to successively rise. Then, the second switching element 313 is successively turned on from a time point when the primary voltage has exceeded the predetermined value Vref until the successive energy input time period is elapsed (in the present specific example, from the above time point to time t4). For simplifying the drawing and the description, FIG. 3 shows an example in which the rise of the energy input period signal IGw coincides with the rise of the second control signal IGb at time t3.

When the second switching element 313 is turned on, the primary current induced by the input energy is passed through the ignition circuit unit during the inductive discharge. In other words, an additional current accompanying the passage of the primary current that is induced by the input energy is superposed on the discharge current that has been passed through the ignition circuit unit from time t2 to the above-described time point. The primary current is superposed (added) in this way until time t4 while the second switching element 313 is being turned on. Thus, the discharge current during the inductive discharge can be increased, well ensuring the ignition discharge to an extent of being sustained.

The magnitude of discharge energy in this case corresponds to the area (integral value) between t2 and t4 in the time chart of FIG. 3 associated with the secondary current I2. In other words, the input energy mentioned above corresponds to an amount obtained by subtracting the triangular area of solely the ignition coil indicated by the broken line, from the area between t2 and t4.

As described above, under the high load or high rotation operating conditions, the blow-off is easily caused. On the other hand, the energy storage state of the capacitor 316 from time t1 to time t2 in which the ignition signal IGt rises to the H level can be controlled by the on-duty ratio of the third control signal IGc. The more the stored energy of the capacitor 316 is increased, the more the input energy is increased when the second switching element 313 is turned on.

Therefore, in the present embodiment, the duty ratio of the third control signal IGc is set higher, as time is elapsed more from the start of ignition under the high load or high rotation operating conditions that easily cause the blow-off. With this setting, the energy storage amount of the capacitor 316 or the amount of the input energy can be appropriately set in conformity with the operating conditions of the engine 11. Thus, the blow-off can be minimized, and the electrode wear of the spark plug 19 caused by power saving or waste of spark energy can also be minimized.

The state of flow of discharge current during the inductive discharge can be appropriately controlled by adjusting the amount of discharge of stored energy from the capacitor 316 with the turning on/off of the second switching element 313. In this regard, as described above, in the configuration of the present embodiment, the second switching element 313 is non-intermittently turned on during the inductive discharge so that the second switching element 313 is in an on state over the successive energy input time period mentioned above. Specifically, during the successive energy input time period, the second switching element 313 is successively turned on. Thus, as illustrated in FIG. 3, energy is intensively inputted, supplying the primary current from the low voltage side terminal to the primary winding 310*a* such that the waveform is changed into an arc shape.

As described above, in the configuration of the present embodiment, the state of flow of the discharge current can be well controlled in conformity with the state of gas flow in the cylinder 11*b* so as not to cause the blow-off. Therefore, according to the present embodiment, the occurrence of the blow-off and the accompanying ignition energy loss can be favorably minimized with a simple device configuration. In other words, according to the present embodiment, the combustion state of the air fuel mixture can be favorably stabilized, while the increase in the size and manufacturing cost of the ignition control device 30 (the ignition circuit unit 31 in particular) can be minimized as much as possible.

In particular, in the configuration of the present embodiment, energy is inputted from the low voltage side terminal of the primary winding 310*a* (from the first switching element 312 side). Thus, energy can be inputted at a lower voltage than in the case where energy is inputted from the secondary winding 310*b* side.

In this regard, if energy is inputted from the high voltage side terminal of the primary winding 310*a* at a voltage higher than the output voltage of the direct-current power supply 311, efficiency is impaired due to the current flowing into the direct-current power supply 311. In contrast to this, according to the configuration of the present embodiment, energy is inputted from the low voltage side terminal of the primary winding 310*a* as described above. Thus, the configuration of the present embodiment can achieve a good effect of most easily and efficiently inputting energy to the primary winding 310*a*.

<Modifications>

Some representative modifications will be described below. In the following description of the modifications, components having configurations and functions similar to those described in the above embodiment are given the same reference numerals and signs as those of the above embodiment. In the description of these components, the description of the above embodiment is appropriately used in a range of not causing technical inconsistency. As a matter of course, modifications are not limited to the ones enumerated below. A part of the above embodiment and all or a part of the modifications can be appropriately adapted in combination in a range of not causing technical inconsistency.

The present invention is not limited to the specific configuration exemplified in the above embodiment. In other words, for example, a part of the functional block of the electronic control unit 32 can be integrated with the driver circuit 319. Alternatively, the driver circuit 319 can be split into segments on a switching-element basis. In this case, when the first control signal IGa is the ignition signal IGt, the ignition signal IGt may be directly outputted from the electronic control unit 32 to the first control terminal 312G of the first switching element 312 without intervention of the driver circuit 319.

The rising timing of the IGa signal does not necessarily have to be coincided with the rising timing of the IGc signal. For example, the driver circuit 319 may be ensured to firstly generate and output only the IGc signal in synchronization with the rise of the IGt signal, and then output the IGa a little later. In other words, the IGa signal may be delayed from the IGc signal. Thus, energy stored in the capacitor 316 can be increased. On the other hand, the IGc signal may be delayed from the IGa signal.

The present invention is not limited to the specific operations shown in the above embodiment. For example, in the above specific examples, the successive energy input time period is determined by the energy input period signal IGw set based on the engine parameters and the timing at which the primary voltage exceeds the predetermined value Vref during the inductive discharge. In FIG. 3, the rise of the energy input period signal IGw is permitted to coincide with the rise of the second control signal IGb. However, the present invention is not limited to such a mode.

Specifically, for example, the rise of the second control signal IGb can be delayed from the rise of the energy input period signal IGw (t3). However, as described above, the energy input period signal IGw is set based on the engine parameters so that the blow-off is minimized as much as possible. Accordingly, as illustrated in FIG. 3, the rise of the energy input period signal IGw substantially coincides with the rise of the second control signal IGb in many cases.

From this viewpoint, the second control signal IGb may be the same as the energy input period signal IGw. In this case, the primary voltage acquiring section 318 can be omitted. In other words, switching control (on/off control) of the second switching element 313 may be performed according to the engine parameters without having the primary voltage acquiring section 318 acquired (monitored) the primary voltage. In this case, the electronic control unit 32 corresponds to the control unit of the present invention, in place of or together with the driver circuit 319.

The present invention is not limited to the mode in which the second switching element 313 is successively turned on from the time point when the primary voltage has exceeded the predetermined value Vref until the successive energy input time period is elapsed. In other words, the second control signal IGb may be temporarily permitted to fall at a time point when the primary voltage has dropped below the predetermined value Vref.

In this case as well, the second switching element 313 can be turned on several times in the energy input period signal IGw. However, even in this case, the second control signal IGb is different from a so-called PWM control signal. Thus, even in this case, the turn-on operation of the second switching element 313 can be taken as being non-intermittently performed.

Instead of the engine parameters, another piece of information usable for generating the second control signal IGb or the third control signal IGc may be outputted from the electronic control unit 32 to the driver circuit 319.

The circuit configuration for supplying input energy from the low voltage side terminal of the primary winding 310*a* (circuit configuration connected to the second power supply side terminal 313D of the second switching element 313) is not limited to the specific example shown in the above embodiment. Specifically, for example, the circuit configuration may be an insulating DC-DC converter or a forward converter. Alternatively, the circuit configuration may be a high voltage battery installed such as in a hybrid vehicle.

As a matter of course, the modifications not specifically referred to should also be encompassed by the technical scope of the present invention within the range not modifying the essential parts of the present invention. In the components configuring the means for solving the problems of the present invention, the operationally and functionally expressed components should encompass the specific configurations disclosed in the above embodiment and modifications and the equivalents thereof, as well as any configuration that can achieve the operations and functions.

REFERENCE SIGNS LIST

11 . . . Engine
11*b* . . . Cylinder
19 . . . Spark plug
30 . . . Ignition control device
31 . . . Ignition circuit unit
32 . . . Electronic control unit
310 . . . Ignition coil
310*a* . . . Primary winding
310*b* . . . Secondary winding
311 . . . Direct-current power supply
312 . . . First switching element
312C . . . First power supply side terminal
312E . . . First grounded side terminal
312G . . . First control terminal
313 . . . Second switching element
313D . . . Second power supply side terminal
313G . . . Second control terminal
313S . . . Second grounded side terminal
314 . . . Third switching element
314C . . . Third power supply side terminal
314E . . . Third grounded side terminal
314G . . . Third control terminal
315 . . . Energy storage coil
316 . . . Capacitor
318 . . . Primary voltage acquiring section
319 . . . Driver circuit
IGa . . . First control signal
IGb . . . Second control signal
IGc . . . Third control signal
IGt . . . Ignition signal
IGw . . . Energy input period signal

What is claimed is:

1. An ignition control device configured to control operation of a spark plug provided to ignite an air fuel mixture in a cylinder of an internal combustion engine, characterized in that the device comprises:

an ignition coil having a primary winding and a secondary winding and configured to generate a secondary current in the secondary winding connected to the spark plug by increasing/decreasing a primary current that is a current passing through the primary winding;

a direct-current power supply having a non-grounded side output terminal connected to one end of the primary winding so that the primary current is passed through the primary winding;

a first switching element that is a semiconductor switching element having a first control terminal, a first power supply side terminal, and a first grounded side terminal, the semiconductor switching element being configured to control turning on/off of a current across the first power supply side terminal and the first grounded side terminal on the basis of a first control signal inputted to the first control terminal, in which the first power supply side terminal is connected to another end of the primary winding and the first grounded side terminal is connected to ground;

a second switching element that is a semiconductor switching element having a second control terminal, a second power supply side terminal, and a second grounded side terminal, the semiconductor switching element being configured to control turning on/off of a current across the second power supply side terminal and the second grounded side terminal on the basis of a second control signal inputted to the second control terminal, in which the second grounded side terminal is connected to another end of the primary winding;

a third switching element that is a semiconductor switching element having a third control terminal, a third power supply side terminal, and a third grounded side terminal, the semiconductor switching element being configured to control turning on/off of a current across the third power supply side terminal and the third grounded side terminal on the basis of a third control signal inputted to the third control terminal, in which the third power supply side terminal is connected to the second power supply side terminal of the second switching element and the third grounded side terminal is connected to ground;

an energy storage coil that is an inductor interposed in an electric power line connecting the non-grounded side output terminal of the direct-current power supply to the third power supply side terminal of the third switching element, in which the energy storage coil is provided to store energy by turning on the third switching element;

a capacitor connected in series with the energy storage coil, being located at a position between the non-grounded side output terminal of the direct-current power supply and the ground, the capacitor being provided to store energy by turning off the third switching element; and a control unit provided to control the second switching element so that during ignition discharge at the spark plug started by turning off the first switching element, the second switching element is non-intermittently turned on to cause the capacitor to discharge stored energy for supplying the primary current from the another end to the primary winding, wherein during the ignition discharge, the control unit non-intermittently turns on the second switching element over an energy input time period.

2. The ignition control device according to claim 1, characterized in that the control unit non-intermittently turns on the second switching element over the energy input time period so that the primary current supplied from the another end to the primary winding has a waveform that is changed in an arc shape.

3. The ignition control device according to claim 1, characterized in that the device further comprises:

a primary voltage acquiring section provided to acquire a primary voltage that is a voltage applied to the primary winding, wherein the control unit controls the second switching element on the basis of the primary voltage acquired by the primary voltage acquiring section.

* * * * *